US007520102B1

(12) United States Patent
diGirolamo et al.

(10) Patent No.: US 7,520,102 B1
(45) Date of Patent: Apr. 21, 2009

(54) ANCHOR BOLT ASSEMBLY HAVING A CORROSION RESISTANT BUSHING

(75) Inventors: Edward R. diGirolamo, Raleigh, NC (US); Michael L. Torres, Raleigh, NC (US); Milan Dragic, Wake Forest, NC (US)

(73) Assignee: The Steel Network, Inc., Raleigh, NC (US)

( * ) Notice: Subject to any disclaimer, the term of this patent is extended or adjusted under 35 U.S.C. 154(b) by 635 days.

(21) Appl. No.: 11/212,365

(22) Filed: Aug. 26, 2005

(51) Int. Cl.
*E04B 1/00* (2006.01)
*E04G 21/00* (2006.01)

(52) U.S. Cl. ..... 52/741.13; 52/295; 52/700; 52/701; 52/708; 52/293.1

(58) Field of Classification Search ..... 52/700, 52/701, 708, 711, 301, 706, 698, DIG. 11, 52/741.13, 293.1, 98, 99, 100
See application file for complete search history.

(56) References Cited

U.S. PATENT DOCUMENTS 3,500,607 A * 3/1970 Wilson ..... 52/699
3,552,734 A * 1/1971 Severino et al. ..... 269/287
3,852,931 A * 12/1974 Morse et al. ..... 52/293.3
3,854,371 A * 12/1974 Lamothe ..... 411/337
4,079,912 A * 3/1978 Haydock ..... 249/184
5,050,364 A * 9/1991 Johnson et al. ..... 52/705
5,060,436 A * 10/1991 Delgado, Jr. ..... 52/295
5,249,404 A * 10/1993 Leek et al. ..... 52/702
6,006,487 A * 12/1999 Leek ..... 52/698
6,273,393 B1 * 8/2001 McCoy ..... 249/219.1
6,327,831 B1 * 12/2001 Leek ..... 52/698
6,347,916 B1 * 2/2002 Ramirez ..... 411/372.5
7,174,689 B2 * 2/2007 Alyea et al. ..... 52/700

* cited by examiner

*Primary Examiner*—Richard E Chilcot, Jr.
*Assistant Examiner*—Chi Q Nguyen
(74) *Attorney, Agent, or Firm*—Coats & Bennett, P.L.L.C.

(57) ABSTRACT

An anchor bolt assembly is provided for connecting a sill to a foundation. The anchor bolt assembly includes an anchor bolt having a threaded end and another end that extends into the foundation. A corrosion resistant bushing extends around a portion of the anchor bolt for isolating the anchor bolt from a treated sill and providing an impervious barrier around a portion of the anchor bolt so as to prevent the anchor bolt from becoming corroded due to the treated nature of the seal.

3 Claims, 5 Drawing Sheets

ANCHOR BOLT ASSEMBLY HAVING A CORROSION RESISTANT BUSHING

FIELD OF THE INVENTION

The present invention relates to static structures and more particularly to an anchor bolt assembly for connecting a treated sill to a foundation.

BACKGROUND OF THE INVENTION

Wood treated for decay and insect resistance is typically used on building construction in applications particularly susceptible to wood destroying organisms. The most common application is for sills, which are generally the elongated wooden plates anchored to the tops of foundations to facilitate connection of floor and wall framing. These plates are generally 2"×6" or 2"×8" cross section pieces of treated lumber. In some applications two or more such plates are stacked to create thicker sills. Sills must, by all applicable building codes, be appropriately anchored to the foundations. The most common method of anchorage entails the use of anchor bolts, the unthreaded ends of which are embedded into the tops of foundation walls leaving the threaded ends projecting upwards above the walls. These anchor bolts are embedded at certain intervals along the horizontal length of the foundation wall, and the sills are drilled to provide holes which align with the bolts. The sills are placed over the bolts, and washers and nuts are applied and tightened to secure the sills to the walls.

The most commonly used wood treatment material is chromated copper arsenate (CCA). However, due to concerns about leaching of arsenic from the wood and the potential health hazards associated therewith, CCA is being phased out of usage for treating wood. Alternatives are known to be more corrosive to metal components used in conjunction with the treated wood. Corrosion of metal fasteners, such as anchor bolts and washers, presents an important issue of building integrity and safety. There exists then the need for means to protect metal fasteners from the corrosive effects of these chemicals.

Several kinds of metal protecting means have been employed or are being considered. Among them are fabrication of anchor bolts from corrosion-resistant alloys, painting impermeable compounds onto anchor bolts, and galvanic coating such as zinc. Corrosion resistant alloys are significantly more expensive than regular steel bolts. Painting materials on the steel bolts is only slightly more expensive, but highly subject to failure due to surface imperfections and scratches occurring in handling and assembly. Galvanic coatings are somewhat more expensive and will provide protection for a time period. However, these coatings work in a sacrificial mode to isolate steel from corrosion and their effectiveness will dissipate over time.

Thus there exists a need for a reliable method of protecting anchor bolt assemblies from corrosion arising from wood treatment chemicals.

SUMMARY OF THE INVENTION

The present invention relates to an anchor bolt assembly that extends through an opening in a treated wood sill for securing the sill to a foundation. Forming a part of the anchor bolt assembly is an anchor bolt having opposed end portions, one end portion adapted to extend into and to be anchored within the foundation and another end portion that is threaded. Additionally, the anchor bolt assembly includes a corrosion resistant bushing that extends around a portion of the anchor bolt for isolating the anchor bolt from the treated sill and providing an impervious barrier around a portion of the anchor bolt so as to prevent the anchor bolt from being corroded due to the treated nature of the sill.

Further, the present invention entails a method of protecting an anchor bolt from the corrosive effects of a treated wood sill. This method entails inserting an anchor bolt through an opening in the treated wood sill that forms a part of a building structure and which lies between a support structure such as a foundation and a series of wall studs. Additionally, the method entails inserting a polymeric bushing into the opening and surrounding the anchor bolt with the bushing such that the bushing forms an impervious barrier between the anchor bolt and the treated wood sill.

In addition, in one particular embodiment, the present invention entails a method of connecting a sill comprised of one or more treated wood members having a certain thickness to a foundation wherein an anchor bolt is embedded vertically into the top of a foundation with at least an upper threaded portion of the anchor bolt disposed above the foundation. At least one hole or opening is formed in the sill such that the vertically disposed end of the anchor bolt extends through a hole in the sill. Further there is provided a bushing having an elongated tubular section of a selected length and a flange section disposed perpendicular thereto. This tubular section is interposed over the bolt and disposed inside the hole of the sill so that the elongated tubular section is disposed around the bolt and the flange section rests on top of the sill. The length of the tubular section is slightly less than the thickness of the sill and wherein a nut is engaged with the end of the bolt and tightened, thereby causing the sill to be pressed against the foundation and to be compressed between the flange section of the bushing and the top of the foundation such that the bottom end of the elongated tubular section is caused to make contact with the top of the foundation.

Another embodiment of the present invention entails a wall section for a building. This wall section includes a treated wood sill and a support structure underlying and supporting the treated wood sill. A plurality of studs extend upwardly from the sill and there is provided at least one opening extending through the sill. At least one anchor bolt assembly secures the sill to the support structure. This anchor bolt assembly includes an anchor bolt and a corrosion resistant bushing that extends around a portion of the anchor bolt for isolating the anchor bolt from the treated sill.

Other objects and advantages of the present invention will become apparent and obvious from a study of the following description and the accompanying drawings which are merely illustrative of such invention.

DETAILED DESCRIPTION OF THE INVENTION

The present invention entails an anchor bolt assembly indicated generally by the numeral 10. Anchor bolt assembly 10 is utilized to make a connection between a treated wood sill and a foundation by employing an impervious polymeric bushing to effectively prevent contact between the wood and the anchor bolt assembly. As will be appreciated from subsequent portions of the disclosure, in a typical application, a wooden sill is anchored to a masonry foundation by means of a series of anchor bolts embedded in the foundation with threaded ends extending above the foundation. Wooden sills with holes drilled to fit over the extended threaded ends of the anchor bolts is placed on the foundation, and a washer and a nut are used to tighten the connection. The bushing comprises an elongated tubular structure with a perpendicular flange on one end. Upon assembly, the bushing is placed over the threaded end of the anchor bolt and into the hole in the sill thereby effectively preventing contact of the anchor bolt with the wood sill. The flange also provides a positive positioning of the bushing within the hole in the sill and protects the washer and the above disposed nut from the treated wood. It is appreciated that the impervious nature of the bushing is such that any chemicals or compounds emanating from the sill are prevented from having unvented contact with the anchor bolt, securing nut or washer.

Figure 1:
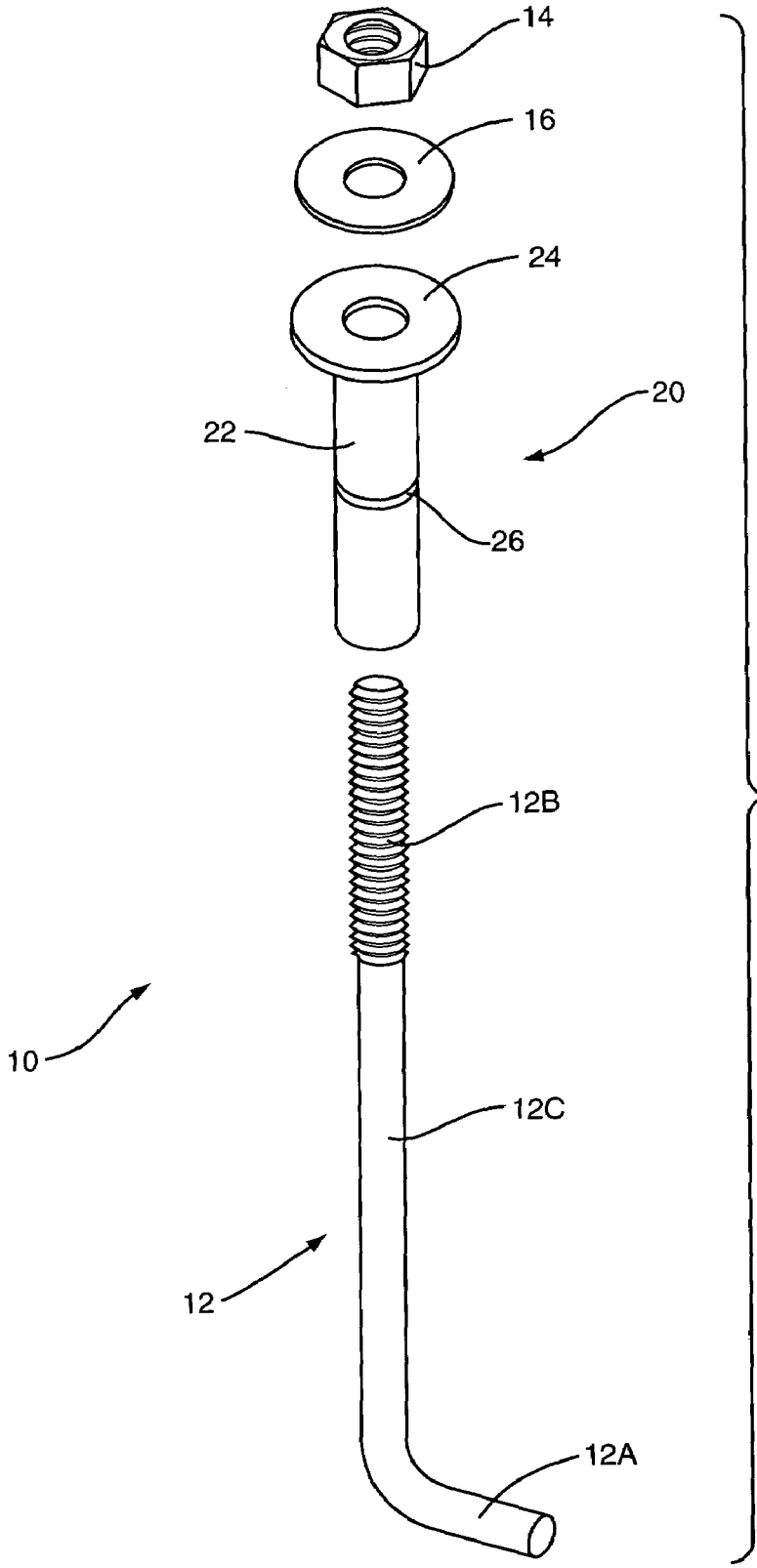
FIG. 1 is an exploded view of the anchor bolt assembly of the present invention.

Turning particularly to the drawings and the description of the anchor bolt assembly, the anchor bolt assembly 10 includes an anchor bolt 12. Anchor bolt 12 includes an anchor end 12A, a threaded end 12B and an intermediate portion 12C. Intermediate portion 12C extends between the anchor end 12A and the threaded end 12B. While the anchor bolt 12 may assume various shapes, in some embodiments the anchor end 12A is either turned as shown in FIG. 1 or can be curved to embed into a foundation.

Further, anchor bolt assembly 10 includes a nut 14 and a washer 16. As will be appreciated from subsequent portions of the disclosure, the nut 14 is utilized to secure the anchor bolt assembly 16 within a sill. In particular, nut 14 is tightened onto the threaded end 12B of the anchor bolt such that it engages the washer 16 and secures the anchor bolt assembly between the foundation and the sill.

A bushing indicated generally by the numeral 20 also forms a part of the anchor bolt assembly 10. Bushing 20 includes an elongated tubular section 22 and an upper flange 24. Formed intermediately on the tubular section 22 is a circumferential break line 26. Essentially, the thickness of the tubular section 22 is reduced around the break line 26 such that the tubular section can be easily broken and separated along the break line 26. As will be appreciated from subsequent portions of the disclosure, the break line 26 formed in the tubular section 22 of the bushing 20 permits the bushing 20 to be utilized with sills of varying thicknesses. For example, the bushing 20 shown in FIG. 1 can be utilized in a thicker sill, a sill such as that shown in FIG. 6 and comprised of two wood members, one laid over the other. By breaking off the lower portion of the tubular section 22, the bushing 20 is effectively shortened. In that case, the bushing 20 is effective in a single wood member sill such as that shown in FIGS. 4 and 5.

It is contemplated that the bushing 20 will be made of a material that will resist corrosion and particularly the harmful effects of any chemicals or compositions that are used to treat the wood sill. In one embodiment it is contemplated that the bushing 20 will be made of a plastic or polymeric material.

In FIGS. 2-6, there is shown the anchor bolt assembly 10 being utilized to connect one or more sills to a foundation wall. For purposes of reference, the foundation comprises a series of concrete blocks 30. Blocks 30 include hollow cavities that receive concrete fill 32. Other forms of support structures or foundation walls can be utilized. Disposed over the foundation is one or more sills with each sill being indicated by the numeral 40. As noted above, it is typically to use sills that are generally 2" by 6" or 2" by 8" and which have been appropriately treated.

Figure 2:
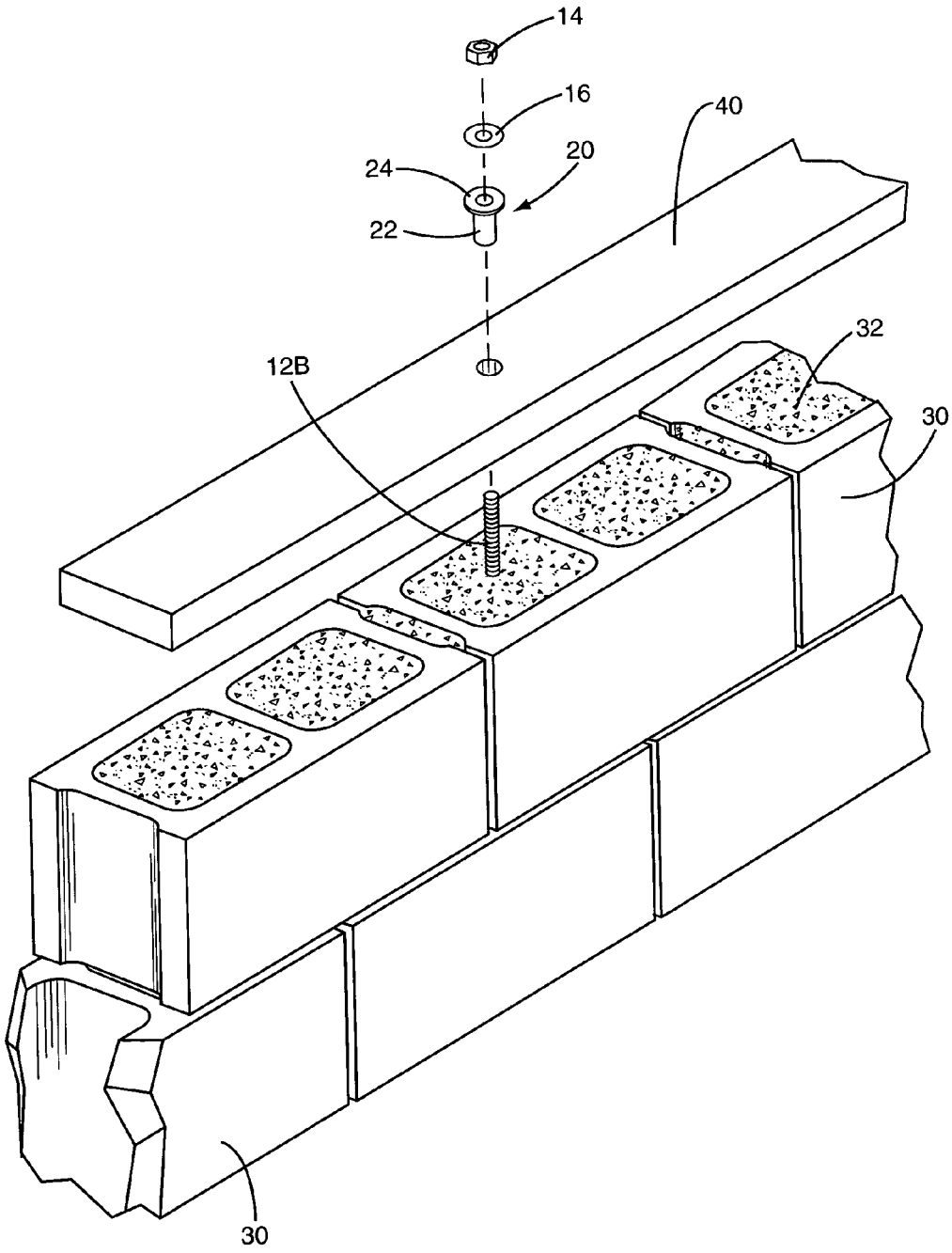
FIG. 2 is an exploded view of the anchor bolt assembly of the present invention shown in combination with a foundation and a sill.
Figure 3:
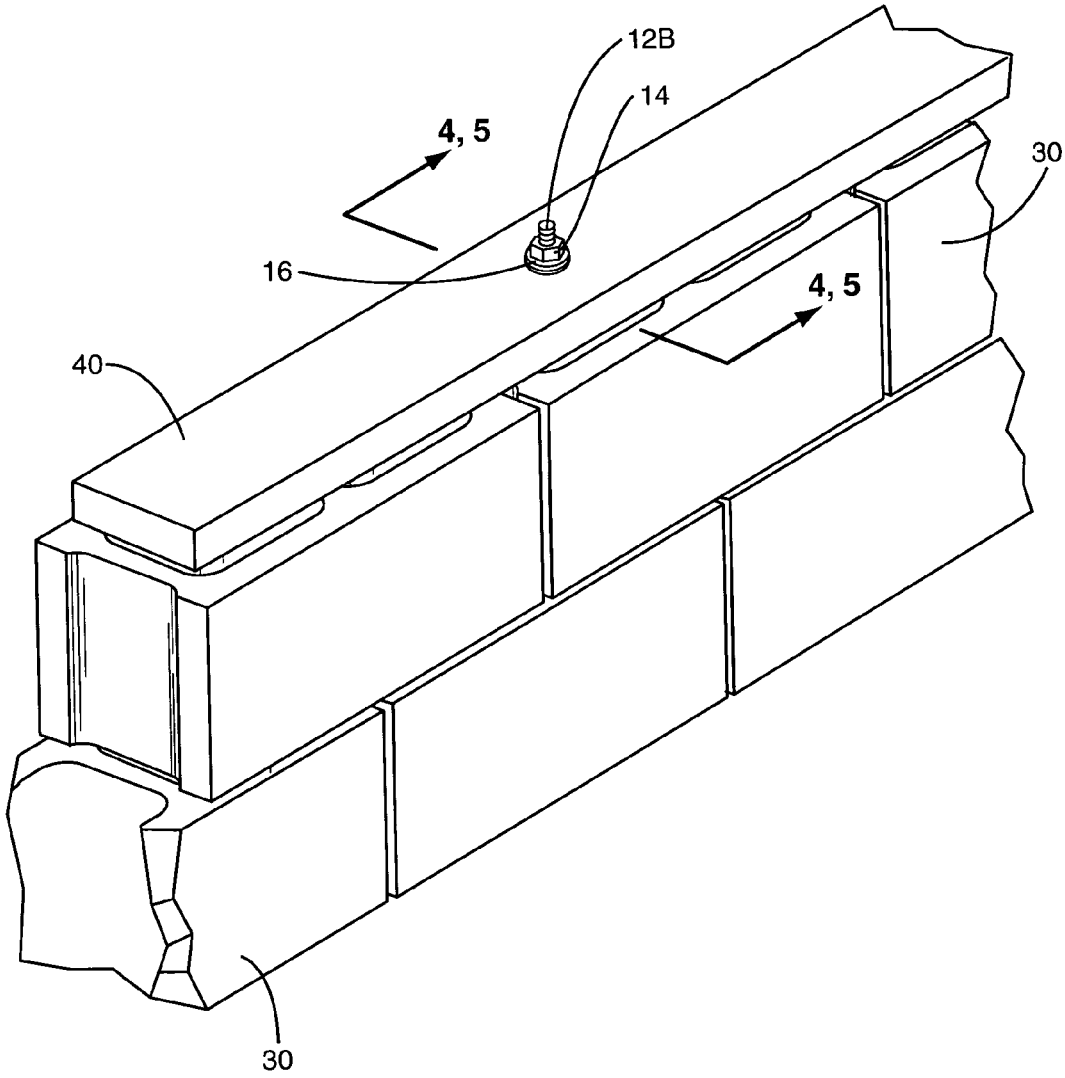
FIG. 3 is a perspective view showing the anchor bolt assembly of the present invention securing the sill to the foundation.

Turning to FIG. 2, the anchor bolt assembly 10 is illustrated therein and shown in an exploded configuration in relationship to the foundation and a single sill 40. Note that the anchor bolt 12 is embedded in the concrete fill 32 and projects upwardly therefrom through an opening in the sill 40. Typically a wall structure would include a series of anchor bolt assemblies 10 uniformly spaced along the foundation wall. In any event, threaded portion 12B of the anchor bolt is projected through the opening in the sill. Because only one sill 40 is utilized, the lower portion of the bushing 20 has been separated along the break line 26, leaving a relatively short bushing 20.

Figure 4:
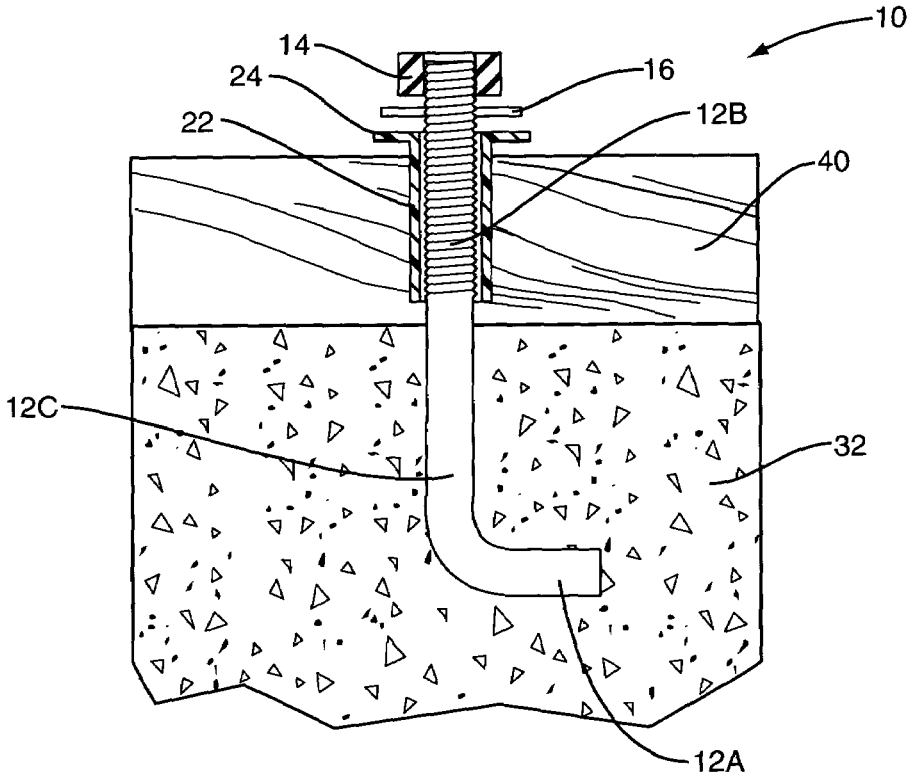
FIG. 4 is a sectional view illustrating the anchor bolt assembly anchored within a foundation prior to the securing nut being tightened.

Turning to FIG. 4, the anchor bolt assembly 10 is shown extending upwardly through the concrete fill 32 and through an opening formed in a single sill 40. In FIG. 4, the nut 14 has not been tightened down on the threaded portion 12B of the anchor bolt 12. Note in FIG. 4 where the lower terminal end of the tubular section 22 of the bushing 20 is spaced slightly above the foundation. In other words, the lower terminal end of the bushing 20 terminates short of the bottom of the sill 40.

Figure 5:
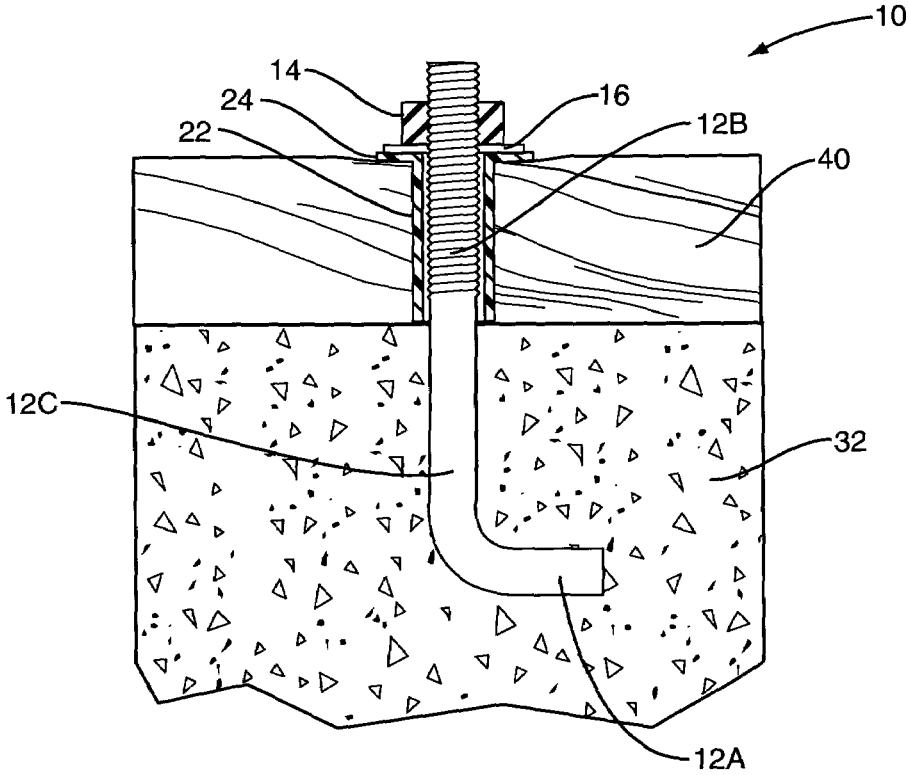
FIG. 5 is a view similar to FIG. 4, but with the nut being fully tightened.

FIG. 5 shows the anchor bolt assembly 10 fully secured between the foundation and the sill 40. The length of the bushing 20 should be established based on the height of the sill 40. It is contemplated that the length of the tubular section 22 should be slightly less than the height of the sill 40. Thus, when the nut 14 is tightened down on the washer 16 it is appreciated that the washer 16 will engage the upper face of the flange 24. Once the nut 14 has caused the washer 16 to engage the flange and push the flange against the top of the sill 40, the length of the bushing 20 may still be such that the lower terminal end does not quite reach the bottom of the sill 40. However, by continuing to tighten the nut 14 the washer 16 will be driven downwardly against the flange 24 and the flange 24 can slightly compress the wood of the sill 40 causing the top portion of the sill underneath the flange 24 to be slightly compressed. This amount of compression should allow the lower terminal end of the tubular section 22 of the bushing to extend downwardly and seat against the foundation.

Figure 6:
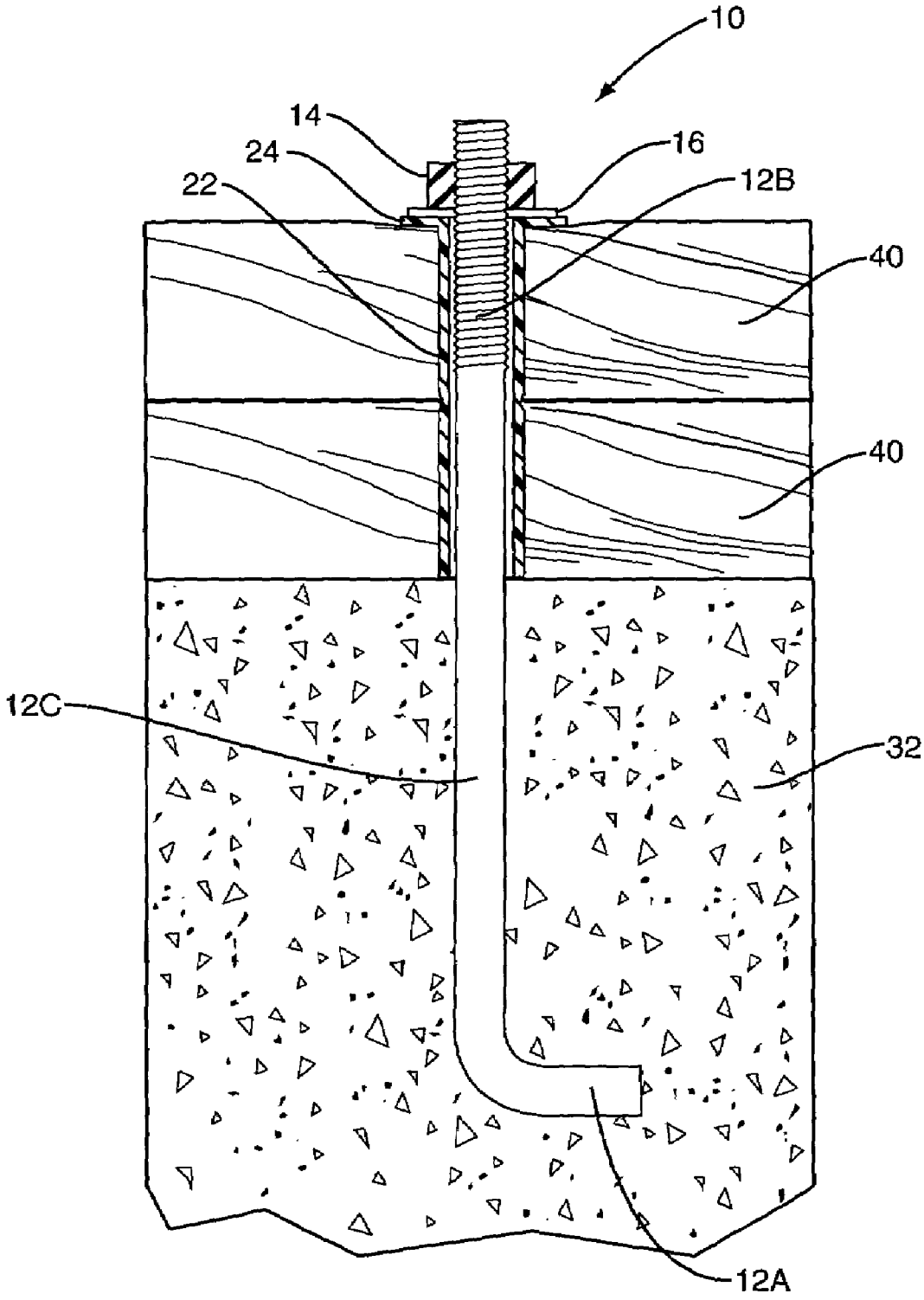
FIG. 6 is a view similar to FIG. 5 wherein the sill is comprised of two members, one disposed over the other.

As noted above, in certain situations the sill can comprise two members disposed one over the other. This is illustrated in FIG. 6. In this case, the tubular section 22 assumes the length shown in FIG. 1. That is, the lower portion has not been broken off along the break line 26. Indeed the break line 26 can be seen in FIG. 6. However, the length of the tubular section 22 that forms a part of the bushing 20 in one embodiment would be of a length such that when the flange fits flush against the top surface of the top sill, that the lower terminal end of the tubular section 22 would terminate just short of the foundation or short of the bottom surface of the lower most sill 40. Again, the nut 14 can be tightened down on the washer 16 so as to drive the same into contact with the flange 24 and to press the flange into the top surface of the top sill 40. This compression will result in the lower terminal end of the tubular section 22 seating against the foundation.

From the foregoing specification and discussion, it is appreciated that by interposing the bushing 20 between the sill 40 and the anchor bolt assembly, than an impervious barrier is formed that prevents corrosion causing chemicals and compositions from reaching the metal components of the anchor bolt assembly 10. This, of course, prevents the components of the anchor bolt assembly 10 from becoming corroded, which in turn compromises the strength and integrity of these connectors.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method of protecting an anchor bolt from the corrosive effects of a treated wood sill, comprising:

a. inserting an anchor bolt through an opening in the treated wood sill that forms a part of a building structure and which lies between a support structure and a series of wall studs;

b. inserting a polymeric bushing into the opening and surrounding the anchor bolt with the bushing such that a flange on a first end of the bushing rests on a top surface of the sill and an end of the bushing opposite the flange terminates in the opening short of the bottom of the sill;

c. securing a fastener on the anchor bolt and tightening the fastener down to exert a force on the flange; and d. continuing to tighten the fastener and pressing the flange into the top surface of the sill and seating the flange in a depression formed in the top surface of the sill by driving the flange into the top surface of the sill and extending the opposite end of the bushing downwardly to at least the bottom of the sill such that the bushing forms an impervious barrier between the anchor bolt and the treated wood sill.

2. The method of claim 1 including inserting a washer between the threaded fastener and the flange of the bushing.

3. The method of claim 1 wherein the sill overlies a support structure and wherein the bushing is pushed downwardly to where the end of the bushing terminates in contact with the support structure.

* * * * *